United States Patent [19]

Penven

[11] Patent Number: 4,806,413

[45] Date of Patent: Feb. 21, 1989

[54] PAPERMAKER'S FELT CONTAINING SCRIM MATERIAL

[75] Inventor: Patrick H. Penven, Clinton, S.C.

[73] Assignee: Asten Group, Inc., Charleston, S.C.

[21] Appl. No.: 92,958

[22] Filed: Sep. 4, 1987

Related U.S. Application Data

[63] Continuation of Ser. No. 844,088, Mar. 26, 1986, abandoned.

[51] Int. Cl.[4] ..... B32B 7/02

[52] U.S. Cl. ..... 428/222; 428/234; 428/296; 428/300

[58] Field of Search ..... 428/222, 234, 296, 300

[56] References Cited

U.S. PATENT DOCUMENTS

| | | | |
|---|---|---|---|
| 4,500,588 | 2/1985 | Lundstrom | 428/212 |
| 4,565,735 | 1/1986 | Murka, Jr. et al. | 428/234 |
| 4,601,942 | 7/1986 | Finn et al. | 428/222 |

*Primary Examiner*—Marion C. McCamish
*Attorney, Agent, or Firm*—Volpe and Koenig

[57] ABSTRACT

The present invention provides a solution to the prior art problem of producing a high density papermakers batt fabric or felt which may be secured to an undamaged under layer in an economic manner. The present invention provides these improvements by providing a batt which is comprised of a non-woven low melt scrim to which the batt material is initially needled. Subsequent to producing a batt of the required density, the batt may, if desired, be needled or adhered to an under layer fabric. The completed felt will be subjected a heat pressing operation which will elevate the temperature of the batt to a temperature above the softening temperature of the scrim but below the melting point of the batt fibers. In this manner, the batt and under layer fabric are unified to produce a multilayer papermakers felt with minimum effort and disruption of the under layer.

5 Claims, 1 Drawing Sheet

FIG. 1
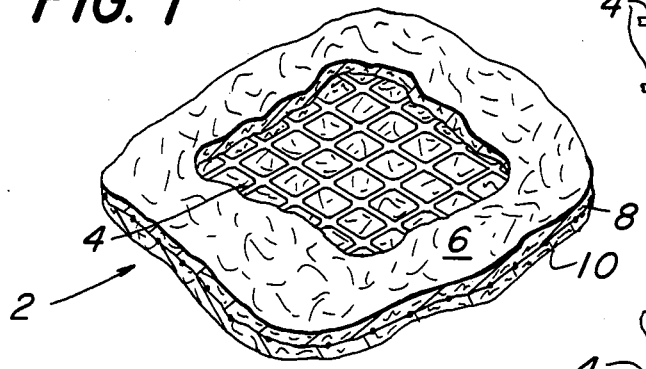
FIG. 5
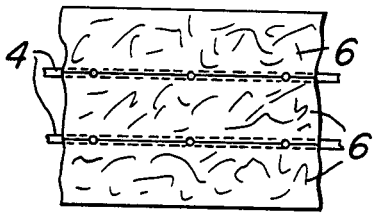
FIG. 6
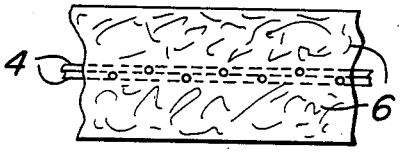
FIG. 2
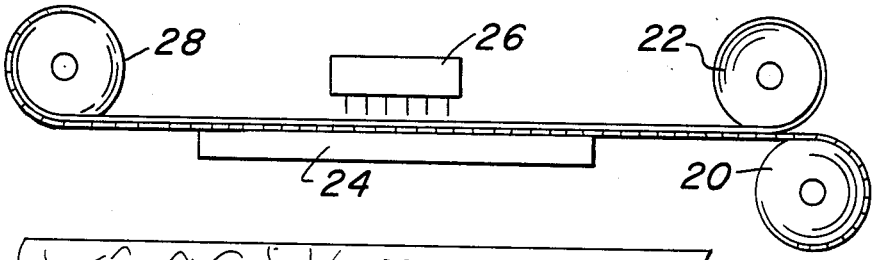
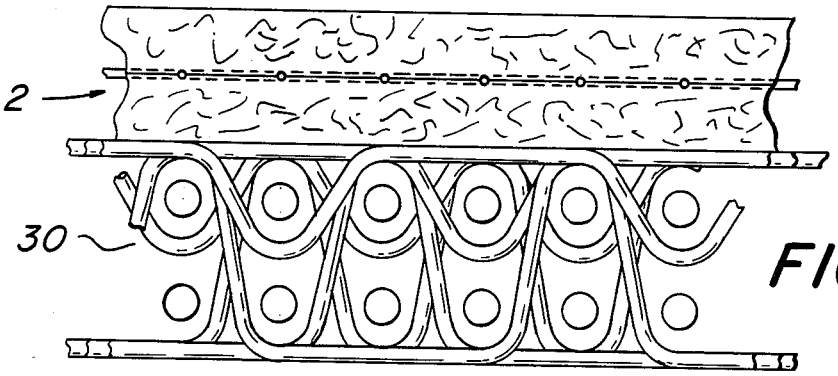
FIG. 3
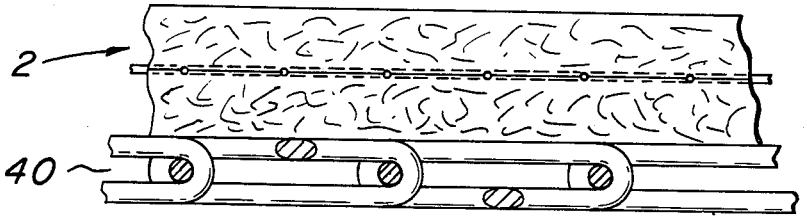
FIG. 4

PAPERMAKER'S FELT CONTAINING SCRIM MATERIAL

This is a continuation of application Ser. No. 844,088, filed Mar. 26, 1986, now abandoned.

BACKGROUND OF THE INVENTION

1. Field of the Invention

The fabric of the instant invention is intended for use in the papermaking industry and finds particular application in the wet press and dryer sections of papermaking equipment. In such equipment, the fabric is a carrying or conveying means which is intended for use in applications requiring either an endless or flat woven fabric. In the papermaking industry, fabrics of the instant invention are frequently referred to as felts, when used in the wet press or dryer section, since they generally comprise a carrier fabric or layer which runs in contact with the equipment and a felt surface which runs in contact with the paper.

2. Description of the Prior Art

It has been recognized in the prior art that it is desirable to provide a felt for use in papermaking machinery which comprises an under layer made of relatively rigid non-deformable material having a compressible felt layer thereon. It has been further recognized by the prior art that it is advantageous to use a needled felt layer in combination with the relatively rigid non-deformable under layer. One example of such a prior art fabric is found in U.S. Pat. No. Re. 21,890 entitled Industrial and Papermakers Felts. This prior art reference discloses the most commonly known needled papermakers felt utilized in the papermaking industry. More recently, an effort to improve the papermakers felt was disclosed in U.S. Pat. No. 4,500,588. This patent discloses the use of a barrier layer contained within the felt. The purpose of this barrier layer is to prevent filler material from penetrating from the surface of the felt into the remainder of the felt.

The difficulty with the prior art approach comes in applying the batt or felt surface to the under layer and in obtaining a batt of sufficient density in an economic manner without damaging the under layer fabric during the needling operation.

SUMMARY OF THE INVENTION

The present invention provides a solution to the prior art problem of producing a high density papermakers felt having an undamaged under layer in an economic manner. The present invention provides these improvements by providing a batt which is comprised of a non-woven low melt scrim to which the batt material is initially needled. Subsequent to producing a batt of the required density, the batt is then needled or adhered to the under layer fabric. The completed felt will be subjected a heat pressing operation which will elevate the temperature of the batt to a temperature above the softening temperature of the scrim but below the melting point of the batt fibers. In this manner, the batt and under layer fabric are unified to produce the papermakers felt with minimum effort and disruption of the under layer.

BRIEF DESCRIPTION OF THE DRAWINGS

FIG. 1 is a fragmentary section of a batt according to the instant invention which is further fragmented to show the scrim.

FIG. 2 is illustrative of one method of producing the batt in accordance with FIG. 1.

FIG. 3 illustrates a batt according to the instant invention unified with a woven under layer.

FIG. 4 is illustrative of a batt according to the instant invention unified with a non-woven under layer which is comprised of a plurality of spiral wound helices which are interconnected by means of pintles.

FIG. 5 is a section cut through a batt which is illustrative of an alternative embodiment utilizing multiple scrims.

FIG. 6 is a section cut through a batt which is illustrative of an alternative embodiment utilizing multiple scrims which are positioned adjacent to each other and in a staggered relationship.

DESCRIPTION OF THE PREFERRED EMBODIMENT

With reference to FIG. 1, there is shown a batt in accordance with the instant invention. The batt 2 is comprised of a scrim 4 which is surrounded by batting material 6 which in the illustration is initially provided as upper layer 8 and lower layer 10. If desired, the batting material 6 may be provided as one or more upper layers 8 with or without lower layer 10. The scrim 4 is preferably comprised of a low melt synthetic material such as polypropylene which has a softening point of about 285° to 330° F. and a melting point of about 320° to 350° F. Other synthetic materials may be selected so long as they have a melting point below that of the batt material 6. It will be noted that the scrim material 4 has a generally regular lattice configuration, however, such a regular configuration is not a requirement, although it is preferred. The regular lattice configuration is preferred since it provides a measure of predictability with respect to the location of the scrim within the batt 2 and does not adversely effect the required moisture absorption or permeability of the batt. It is expected that the scrim will have a finer mesh, more interstices per square inch, in certain applications in which it is desired to reduce marking. With respect to the interstices of the scrim 4, it should be noted that there is no required open area for the interstices but the scrim should be selected with interstices which will not adversely effect the felts' performance in the areas of moisture absorption, marking and/or permeability.

It is intended that the scrim 4 will be selected so as to provide sufficient area for fiber retention while preserving the felt characteristics. In the illustrative embodiment the interstices of the scrim 4 are about one quarter inch squares and the scrim is approximately 15 mils thick. The scrim may be purchased in sheet form or may be made by laying suitable yarns in a lattice work which is then unified by heat setting or ultrasonic means. It will be understood by those skilled in the art that the yarns forming the scrim need not be bonded at each of the intersections but should be bonded in amounts sufficient to permit handling of the scrim.

With respect to the batting material 6 which is shown as comprised of an upper layer 8 and a lower layer 10 prior to needling about scrim 4, it will be understood by those skilled in the art that the initial batt layers 8 and 10 may be formed through the usual needling processes. Additionally, it will be understood by those skilled in the art that the batt material 10 prior to needling with the scrim 4 may comprise a roving of fibers which is placed over the scrim and needled thereto. In addition, it is contemplated that a blanket of roving may be used in place of individual rovings. In the preferred embodiment, it is preferred to use batting material which has been initially needled to provide batting material having a generally uniformed density and to facilitate handling thereof.

With reference to FIG. 2, there is shown a means for producing the batt of FIG. 1. A first supply roll 20 of scrim material is provided and a second supply roll 22 of batt material is provided in close proximity thereto. Both of these materials are provided in unison over a support bed 24 which is positioned below a needling head 26. Needling heads such as 26 are known to those skilled in the art and one example thereof is shown in U.S. Pat. No. Re. 21,890. The materials are presented simultaneously to needling head 26 and are needled in accordance with fabric design to achieve the required density. Subsequent to needling, the material is rewound on supply roll 28. In the event that it is desired to apply a second layer of batt material, the supply roll is then positioned at 20 so that the material discharged from the roll will present the scrim in a face up position towards needling head 26. A second layer of batt is then applied in the same manner as the first. This procedure may continue until such time as the desired thickness for the batt material is achieved.

Depending upon the thickness of the completed batt and the degree of stability desired, the batt produced in accordance with the above may be further provided with another scrim layer and additional batt material or initially provided with two scrims or more. Thus, with reference to FIG. 5 and 6, it can be seen that two scrim layers 4 are provided in the final needled batt. In the embodiment of FIG. 5 the scrim layers are separated by batt material. In the embodiment of FIG. 6 the scrim layers are adjacent to each other. It will be understood by those skilled in the art that the needling process must accomplish sufficient depth of needling to provide the desired uniformity and that the respective layers of batt material 6 will be fully unified and stabilized in the heat treatment process. Likewise, it will be understood by those skilled in the art that the scrims may be vertically aligned, such as FIG. 5, or staggered, such as FIG. 6, depending upon the desired application.

It is during the aforementioned needling operation that the scrim provides a secure base work which prevents excessive fiber migration as a result of the needling operation. As a result of this, it is possible to needle the batt more severely than can be done without the scrim and more severely than can be done directly on the woven or spiral formed under layer. As a result, a more uniformed higher density homogeneous batt is obtained. After the desired thickness of the batt is obtained the batt may be subjected to a heat pressing operation at a temperature below the melting point of the batt fibers but at a temperature sufficient to cause softening or melting (flowing) of the scrim. However, it is preferable to have the heat pressing operation done after needling of the batt to the under layer fabric. It will be understood by those skilled in the art that the temperature will generally exceed the heat setting temperature of the scrim and must be sufficient to result in tackiness of the scrim. It will be further understood that such a temperature may be achieved without a complete melting or flowing of the scrim. It will likewise be understood that the scrim may undergo shape deformation as a result of the heat treatment and that the drawing figures are merely illustrative of the invention.

As a result of the heat treatment of the scrim, it will adhere to the batt fibers and increase the adhesion between the batt materials. In this manner, the scrim will add to the strength of the batt and reduce the likelihood that the batt will experience fiber migration or layer separation during use. As can be seen from the foregone, the scrim provides a denser batt, a more uniformed or homogeneous batt and a batt having greater tenacity than the prior art batts.

With reference to FIG. 3, there is shown a batt 2 according to the instant invention unified with a woven under layer 30. Batt 2 and under layer 30 may be unified through a needling process, such as that described with reference to FIG. 2 and known to those skilled in the art, or may be unified through the application of adhesives between the batt 2 and under layer 30. The application of such adhesives to the batt will be also known to those skilled in the art as exemplified by U.S. Pat. No. 4,528,236.

With reference to FIG. 4 there is shown a batt 2 according to the instant invention adhered to a nonwoven under layer 40 formed of a plurality of helices interconnected by pintles. The fabric of FIG. 4 may be unified in accordance with the method discussed with reference to FIG. 2 or by the application of adhesives. Once again, the methods of unifying the fabric will be known to those skilled in the art and is exemplified by U.S. Pat. No. 4,528,236.

I claim:

1. An improved papermaker's felt of the type having an under layer and a moisture absorbing and air permeable batt layer joined into a single fabric, wherein the improvement comprises a batt layer including fibrous batt material and scrim material, the scrim material having a melting point lower than the melting point of the fibrous batt material, which were repeatedly needled to substantially establish the final batt density, moisture absorption and air permeability through said batt layer prior to joining with said under layer, said scrim material tested to adhere the fibrous batt material while maintaining the moisture absorption and air permeability thorugh said batt layer.

2. An improved papermaker's fabric of the type having an under layer and a moisture absorbing and air permeable batt layer joined into a single fabric, wherein the improvement is a batt layer which comprises:

fibrous batt material; and scrim material, the scrim material having a lower melting point than the melting point of the fibrous batt material and interstices of sufficient open area to permit moisture absorption and air permeability through said scrim material, wherein said batt and scrim materials were repeatedly needled to substantially establish the final density, moisture absorption and air permeability of said batt layer prior to joining with said under layer, said scrim material treated to adhere the fibrous batt material while maintaining the moisture absorption and air permeability through said batt layer.

3. An improved moisture absorbing papermaker's fabric of the type having an under layer and a batt layer joined into a single fabric, wherein the improvement is a batt layer which comprises:

fibrous batt material and scrim material which were repeatedly needled to substantially establish the final density of said batt layer prior to joining with said under wiring, said scrim material having a melting point lower than the melting point of the fibrous batt material and interstices of sufficient open area to permit moisture absorption and permeability through said batt layer, said batt layer treated to adhere the scrim and the fibrous batt materials while maintaining the moisture absorption and air permeability through said batt layers.

4. An improved papermaker's fabric of the type having an under layer and a moisture absorbing, air permeable batt layer jointed into a single fabric, wherein the improvement is a batt layer which comprises:

fibrous batt material and scrim material which were repeatedly needled to substantially establish the final density of said batt layer prior to joining with said under layer, said scrim material having a melting point lower than the melting point of the fibrous batt material and interstices of sufficient open area to preserve the homogenous moisture absorption and air permeability characteristics of said batt layer, said batt layer treated to adhere the scrim and fibrous batt materials while preserving the said characteristics of the batt layer.

5. An improved homogenous, moisture absorbing and air permeable fiber batt for use as a papermaker's fabric, wherein the improvement comprises the combination of fibrous batt material and scrim material, having a lower melting point than the melting point of the fibrous batt material and interstices of less than about one-quarter inch squares which permit moisture absorption and air permeability through said scrim material, which have been repeatedly needled to surround said scrim material with said batt material and to substantially establish the final homogenous density, moisture absorption and air permeability through said fiber batt, said fiber batt treated to adhere the scrim and the fibrous batt materials while maintaining the moisture absorption and air permeability through said fiber batt.

* * * * *

UNITED STATES PATENT AND TRADEMARK OFFICE

CERTIFICATE OF CORRECTION

PATENT NO. : 4,806,413

DATED : February 21, 1989

INVENTOR(S) : Patrick H. Penven

It is certified that error appears in the above-identified patent and that said Letters Patent is hereby corrected as shown below:

Column 4, line 5, delete the "-" between "or-layer".

Column 4, claim 1, line 40, delete the word "tested" and insert therefor --treated--.

Signed and Sealed this

Fifteenth Day of August, 1989

*Attest:*

*Attesting Officer*

DONALD J. QUIGG

*Commissioner of Patents and Trademarks*